United States Patent [19]

Scampini

[11] Patent Number: 4,578,943

[45] Date of Patent: Apr. 1, 1986

[54] HYDRO-VAPOR FREE TURBINE ENGINE

[76] Inventor: Daniel C. Scampini, 1306 Regency Park, Glens Falls, N.Y. 12801

[21] Appl. No.: 673,027

[22] Filed: Nov. 19, 1984

[51] Int. Cl.[4] ..... F01K 25/06

[52] U.S. Cl. ..... 60/39.59; 60/649; 60/673; 60/689

[58] Field of Search ..... 60/39.05, 39.55, 39.57, 60/39.58, 39.5, 39.59, 649, 673, 689

[56] References Cited

U.S. PATENT DOCUMENTS

| | | | |
|---|---|---|---|
| 3,271,947 | 9/1966 | Kemenczky | 60/221 |
| 3,365,891 | 1/1968 | Williams | 60/221 |
| 3,808,804 | 5/1974 | Scott-Scott | 60/221 |
| 4,041,710 | 8/1977 | Kraus et al. | 60/673 |
| 4,495,774 | 1/1985 | Domdey | 60/649 |

OTHER PUBLICATIONS

Biasi, V., *State of the Art: Propulsion,* Jan. 1960, pp. 68–71.

*Primary Examiner*—Carlton R. Croyle
*Assistant Examiner*—Jeffrey A. Simenauer
*Attorney, Agent, or Firm*—Schmeiser & Morelle

[57] ABSTRACT

A hydraulic engine which uses liquid fluid as the working medium consists of a housing structure, a liquid fluid inlet passage, a fluid outlet passage, a liquid fluid pump, a fluid actuator, coupling means connecting the two, fluid flow diffusing means, a combustion chamber, an energy exchange zone, a fuel and air supply means, a combustion ignition means, a power takeoff actuator means, a power takeoff means, and a fluid separating means. Liquid fluid enters the engine inlet where it travels to the energy exchange zone. Here exhausted combustion product in the form of a gaseous fluid is introduced into the liquid fluid where it is combined. The mixture is exhausted through the outlet passage of the engine in the form of a liquid fluid-gaseous fluid stream. Upon entering the outlet passage, the mixture is directed to a fluid separating chamber where the working liquid fluid of the engine is separated from the gaseous combustion product. The liquid fluid is then recirculated back to the inlet of the engine to provide a constant liquid fluid source for engine operation.

1 Claim, 1 Drawing Figure

HYDRO-VAPOR FREE TURBINE ENGINE

BACKGROUND OF THE INVENTION

Internal combustion engines such as reciprocating, rotary, gas-turbine etc., have all been in use for some time now. Each engine possessing its advantages and disadvantages for use. Reciprocating diesel engines for example provide high torgue outputs while relatively low rpm's. Gas turbine engines on the other hand provide high rpm's while relatively low torque unless used with a rather large gear reduction system. All classes of engines are different in one way or another, having their specialty of application which is superior to all others. As efficient as these engines may operate, they still possess the limitations of present-day internal combustion engines. Among these are the following: The engine assemblies are quite heavy and bulky, fuel consumption is high, engine parts overheat, wear down and break, and are very limited in their power output capabilities. A new class of engine called a Hydro-Vapor Free Turbine Engine has been developed that will partially or totally alleviate the limitations mentioned above.

Among the objects of the present invention are the following:

To provide an engine assembly which is lightweight relative to existing engine assemblies of the same capable output powers.

To provide an engine which will not overheat under operation as present-day combustion engines do.

To provide a high efficiency engine for low to high power operation energies.

To provide an engine which is capable of producing very high output energies.

To provide an engine which is simple in construction and operation which may be constructed of various materials such as plastics, steels, and composites.

The preceeding objects of the invention are recognized by constructing a Hydro-Vapor Free Turbine Engine.

SUMMARY OF THE INVENTION

The operation of the Hydro-Vapor Free Turbine is similar to that of the air-breathing gas turbine engine, the main difference being the working medium of the two engines. The gas turbine uses air for compression, combustion, and exhaust drive while the Hydro-Vapor Free Turbine uses a liquid fluid such as water for compression, air for combustion, and a mixture of the two for exhaust drive. The combustion means of the gas turbine is directly exposed to the working medium of the engine as the incoming air is combined with fuel to burn for providing drive. The combustion means of the Hydro-Vapor Free Turbine is for the most part isolated from the working medium of the engine except for the combustion outlet. Only until substantially all of the combustion gases have been utilized for combustion are the gases introduced into the working medium to provide drive. Because of the considerable difference in the mass between air and a liquid such as water, a Hydro-Vapor Free Turbine Engine can achieve the compression requirements necessary for operation at a greatly reduced compressor operation velocity than that of a gas turbine engine. The drive per volume of exhaust is also greatly increased for a Hydro-Vapor Free Turbine over that of the gas turbine since the mass of a liquid such as water is so much greater than that of air. A Hydro-Vapor Free Turbine Engine generally comprising a housing enclosure, a liquid fluid inlet passage, an engine exhaust discharge outlet passage, a liquid fluid pump, a fluid actuator, coupling means connecting the two, a combustion chamber, an energy exchange zone, combustion fuel supply means, combustion air supply means, combustion ignition means, a first and second diffuser means, a power takeoff actuator means, a power takeoff means, and a fluid seperating chamber generally operates as follows: A liquid fluid such as water is introduced into the inlet of the engine where it travels to a liquid fluid pump which pumps it downstream past a first diffuser means to an energy exchange zone. A combustion chamber which is supplied with fuel and air is ignited to produce combustion gases which are expelled from the chamber into the liquid fluid of the engine. It is in the energy exchange zone that this introduction of the combustion exhaust to the liquid fluid takes place. The combustion of liquid fluid and combustion exhaust product is then forced out past a fluid actuator for driving the compressor means and a power takeoff fluid actuator for driving the power takeoff means, and a second diffuser means where it is expelled through the engine exhaust discharge outlet passage. Upon entering the outlet passage, the combination of liquid fluid and combustion product is directed to the fluid separating chamber where the working liquid fluid of the engine is separated from the gaseous combustion product. The liquid fluid is then recirculated back to the inlet of the engine to provide a constant liquid fluid source for engine operation.

BRIEF DESCRIPTION OF THE DRAWING

The drawing furnished here will illustrate the construction of the present invention in which the above advantages and features are clearly disclosed as well as others which will be readily understood from the following description.

DETAILED DESCRIPTION OF THE INVENTION

Figure 1:
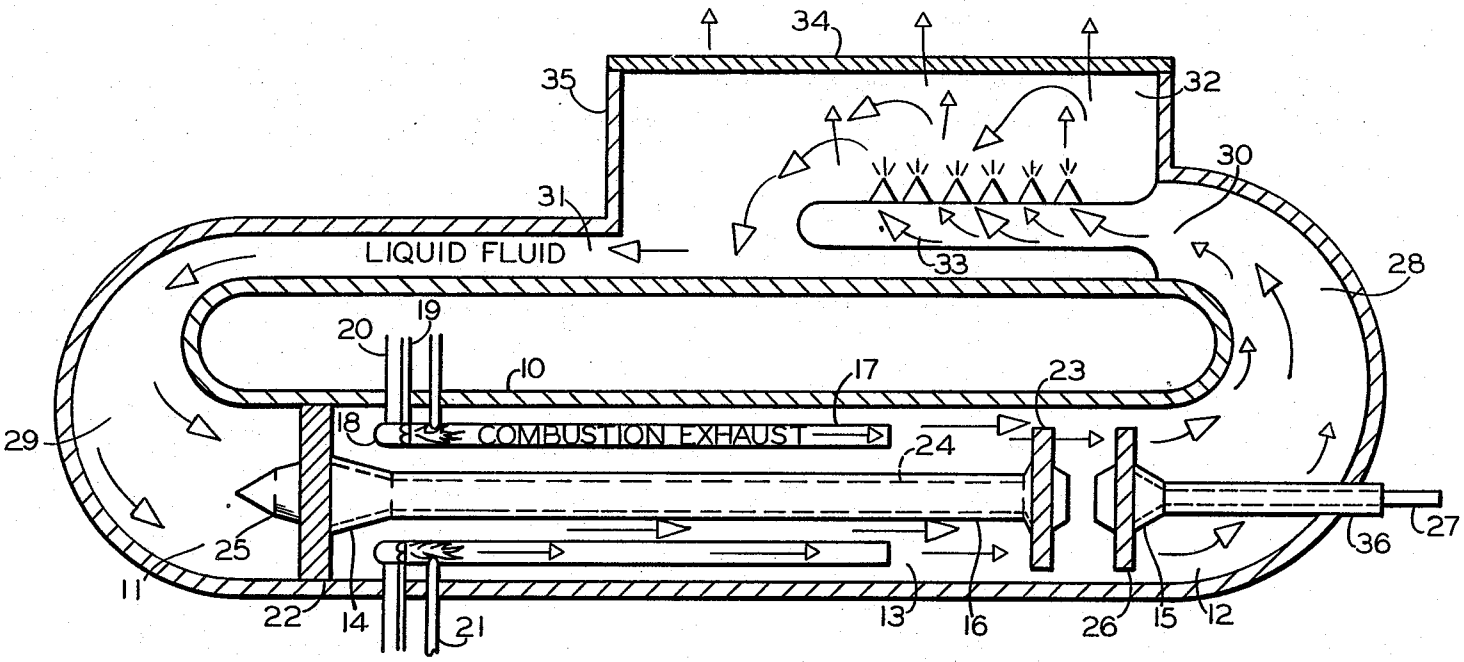
FIG. 1 is a schematic side and longitudinal view of one embodiment of the present invention.

Referring to the drawing in greater detail, the Hydro-Vapor Free Turbine Engine of the present invention consists generally of a housing enclosure 10; a liquid fluid piercing nose 25; a liquid fluid inlet 11; an exhaust discharge outlet 12; a liquid fluid pump 22; a fluid turbine actuator 23; an energy exchange zone 13; a forward liquid fluid diffuser 14; a rearward liquid fluid and combustion exhaust diffuser 15; a driveshaft 24; a driveshaft enclosure 16; a combustion expansion chamber 17; a combustion burner 18; a combustion burner fuel source 19; a combustion burner air source 20; a combustion burner ignition source 21; a power output shaft fluid turbine actuator 26; a power output shaft 27; a output shaft enclosure 36; an exhaust fluid transfer passage 28; a fluid separating chamber fluid inlet 30; fluid seperating chamber liquid fluid outlet 31; fluid separating chamber gaseous fluid outlet 34; liquid fluid-gaseous fluid dispersing unit 33; and a liquid fluid-gaseous fluid seperating section 32. A liquid fluid such as water enters the liquid fluid inlet 11 and is pumped by the liquid fluid pump 22. The fluid is then directed past a forwardly located liquid fluid diffuser 14; where it is then routed to the engine's energy exchange zone 13. Here combustion exhaust gases are expelled into the surrounding liquid fluid chamber from the combustion expansion chamber 17 where they combine together and are forced past rearwardly located liquid fluid and combustion exhaust actuator turbines 23 and 26, and diffuser 15. Once past the diffuser 15, the liquid and gaseous fluid mixture is discharged from the engine through the exhaust discharge outlet 12 to the fluid transfer passage 28. The fluid mixture is then directed to the inlet of the seperating chamber 30 where it is dispersed by the dispersing unit 33. The dispersing unit 33 discharges the mixture into the separating section 32 of the separating chamber where the heavier liquid fluid falls as the lighter gaseous fluid rises up through the gaseous fluid outlet 34 to be expelled. The liquid fluid which remains is recirculated through the outlet 31 to the liquid fluid transfer passage 29 where it if fed back to the engine inlet 11 for reuse. The actuator turbine 23 is driven into motion by the action of the gaseous exhaust and liquid fluid flowing through it during operation. This force is in turn transferred to the compressor turbine 22 by means of the connecting driveshaft 24 to power the pump 22 during engine operation to make the engine cycle self-sustaining. The power takeoff actuator turbine 26 is driven into motion by the action of the gaseous exhaust and liquid fluid flowing through it during operation. This force is transferred to the power output shaft 27 which is used to provide a power source external to the engine for utilization of said power source. The energy exchange zone 13 as depicted in FIG. 1 is defined as the area located inbetween the forward diffuser 14 and the rearward diffuser 15. It is this zone that supplies the backpressure compressive means for the combustion fuel and air mixture within the combustion chamber 17. As pressurized fuel and air is supplied to the combustion burner 18, it is ignited by the ignition source 21. The burning gases release heat and expand within the combustion chamber 17 until they are expelled into the liquid fluid surroundings of the energy exchange zone 13. The combustion chamber gases are continuously exerted on by the surrounding pressures of the energy exchange zone 13 to provide continuous compression of the fuel and air mixture prior to and during combustion to provide efficient burning of the mixture.

The combustion expansion chamber 17 is designed at such a length as to allow enough time to provide for efficient burning of the combustion gases prior to being expelled into the energy exchange zone 13. As the combustion gases are expelled into the energy exchange zone 13, they displace the existing volumes of liquid fluid present. This displaced liquid fluid is then forced downstream with the combustion gases past the actuator turbines 23 and 26, and the rear diffuser 15 where they are discharged through the discharge outlet 12 to produce drive before being recirculated through the seperating chamber 35. This process continues during engine operation.

The fluid flow passages located at the rearward diffuser 15, and discharge outlet 12, transfer passage 28, fluid separating chamber inlet 30, and the fluid dispersing unit 33, are designed to accomodate a higher volume of fluid flow as compared to the forward inlet 11, diffuser 14, transfer passage 29, and fluid separating chamber outlet 31 passages due to the increased volume in fluid flow produced by the addition of the combustion gases into the liquid fluid. The combustion burner 18 and expansion chamber 17 may be positioned either directly in the energy expansion zone 13 during operation, or may be located outside the zone 13 providing that the combustion exhaust is still in communication with the exchange zone 13. The combustion chamber fuel 19 and air 20 supply must obviously be fed to the combustion burner 18 at a high enough pressure to overcome the backpressures exerted on it by the energy exchange zone 13.

The engine may operate on a wide variety of combustion fuels including gaseous fuels such as natural gas or hydrogen, to liquid fuels such as gasoline, diesel, alcohol, or kerosene, to solid fuels such as those used in solid-propellant rockets.

The working liquid fluid of the engine may incorporate a variety of fluids ranging from water to nonflammable hydraulic fluids, to mixtures of solutions such as water and hydraulic fluids.

As illustrated in FIG. 1, the driveshaft enclosures 16 and 36 may be designed to incorporate the primary 14 and secondary 15 diffusers within the same structures. A variety of means may be used for initially starting the engine into operation such as using a electrical, phneumatic, or hydraulic starter unit to rotate the pump up to speed to supply pumped liquid fluid while at the same time igniting the combustion chamber. The engine may also be started into operation by simply activating the combustion chamber.

As the expansing gases are introduced into the energy exchange zone, they force existing liquid fluid downstream past the fluid actuator which in-turn powers the pump up to speed for engine operation. The engine may be used coupled directly to provide a power source (engine used solely) or may be coupled to a transmission to supply necessary power.

The fluid separating chamber 35 does not participate in the actual energy production of the engine, its purpose is for treating the working fluid of the engine for recirculation of said fluid back to the engine for reuse. The working liquid fluid returned to the engine for reuse should be substantially free of gaseous fluid to minimize the effects of cavitation within the engine.

The working fluid of the engine is defined as the fluid which participates in the energy production of the engine.

The fluid flow path through the engine may take on many various forms such as concentric or elliptical depending on the application.

The pump means of the engine comprises any device or process which pumps liquid fluid for engine utilization such as turbines, rotary vane pumps, rotary gear pumps, reciprocating pumps etc.

The actuator means and power takeoff actuator means of the engine comprise any device or process such as fluid powered turbines as well as fluid powered rotary and reciprocating actuators which serve to drive the pump means and the power takeoff means from the operation of the engine. The power takeoff means comprises any coupling means which is operatively connected to the power takeoff actuator such as a driveshaft or transmission to provide a power output external to the engine for utilization.

The term "operatively connected" means that the operation of one device directly or indirectly influences the operation of another device.

When the combustion means is described as being elongated, it means that the path travelled by the combustion gases is lengthened to allow for greater time for combustion to take place before discharging into the energy exchange zone. A combustion chamber tube rolled in a coil serves the same purpose as a lengthly straight combustion tube.

A meshed screen may be used to comprise the gaseous fluid outlet 34.

The screen should be porous enough to allow the gaseous fluid to escape while preventing the liquid fluid from passing through.

In-line filters may be used in the fluid flow paths of the engine to remove debris in the fluid to maintain a clean working fluid.

Temperature regulators such as heat exchangers etc. may also be used to control the temperature of the working fluid of the engine.

The foregoing detailed description has been given for clearness of understanding only and no unnecessary limitations should be understood therefrom as modifications will be obvious to those skilled in the art.

What is claimed is:

1. A closed cycle engine comprising:

(a) a housing enclosure containing a liquid working fluid;

(b) a pump for rapidly conducting said working fluid and placing it in registry with an expansion chamber for mixing high pressure gaseous fluid into said working fluid at an energy exchange zone;

(c) a power turbine coupled by a shaft to said pump for purposes of driving said pump;

(d) a combustion gas generator means comprising a fuel source, an air source and an ignition means, for generating said high pressure gaseous fluid comprised predominently of working fluid vapor and other exhaust gases, said combustion gas generator being internal to said closed cycle engine;

(e) whereby said chamber for mixing said high pressure gaseous fluid into said working fluid, thus augmenting its energy content, imparts additional heat and momentum to said working fluid, thereby obtaining an energy-augmented working fluid mass, said mass being initially directed through said power turbine;

(f) an output turbine for transferring from the engine a portion of the total energy present in said energy-augmented working fluid mass;

(g) a first diffuser located upstream of said pump;

(h) a second diffuser located downstream of said output turbine;

(i) a separation chamber downstream of said output turbine for recovering liquid working fluid from said working fluid vapor mixed in said energy-augmented working fluid mass free of other exhaust gases, wherein said recovered liquid working fluid is recycled along with said working fluid back to said pump.

* * * * *